US005088850A

United States Patent [19]

Taichman et al.

[11] Patent Number: 5,088,850

[45] Date of Patent: Feb. 18, 1992

[54] COMBINED PASTE-DISPENSING AND CLEANING UNIT

[76] Inventors: Jeremy Taichman, 11/6 Yohanan Hasandlar St., Rishon Lezion; Manuel Schwartzman, 1363/20 Ezor Het, Ashdod, both of Israel

[21] Appl. No.: 621,575

[22] Filed: Dec. 3, 1990

[51] Int. Cl.[5] ..... A46B 11/02

[52] U.S. Cl. ..... 401/176; 401/182; 401/268; 401/269

[58] Field of Search ..... 401/176, 182, 132, 268, 401/269

[56] References Cited

U.S. PATENT DOCUMENTS

| | | | |
|---|---|---|---|
| 29,805 | 8/1860 | Middleton | 401/176 |
| 919,440 | 4/1909 | Lawson et al. | 401/269 |
| 2,250,758 | 7/1941 | French | 401/176 |
| 2,377,837 | 6/1945 | Zimmerman | 401/176 |
| 2,642,606 | 6/1953 | Aschenbach | 401/176 |
| 3,417,762 | 12/1968 | Hall | 401/176 |
| 3,432,245 | 3/1969 | Hudson | 401/132 |
| 4,139,312 | 2/1979 | Marano et al. | 401/176 |
| 4,521,128 | 6/1985 | O'Neal | 401/269 X |
| 4,693,622 | 9/1987 | Booth | 401/191 |
| 4,811,445 | 3/1989 | Lagieski | 401/268 X |

FOREIGN PATENT DOCUMENTS

| | | | |
|---|---|---|---|
| 2416001 | 2/1974 | Fed. Rep. of Germany . | |
| 2753602 | 1/1977 | Fed. Rep. of Germany . | |
| 3630151 | 4/1986 | Fed. Rep. of Germany . | |
| 2554331 | 5/1985 | France | 401/132 |
| 2067396 | 8/1984 | United Kingdom . | |
| 2175798 | 12/1986 | United Kingdom | 401/176 |

*Primary Examiner*—Steven A. Bratlie

*Attorney, Agent, or Firm*—Dann, Dorfman, Herrell & Skillman

[57] ABSTRACT

The invention provides a unit for cleaning, brushing, scouring, polishing and the like, comprising a handle terminating with a head, the head having a cleaning body extending from a surface thereof and a throughgoing aperture, and the unit further comprising an external paste-containing holder having a paste-dispensing nozzle, the handle and the holder having means for interlocking engagement with the dispensing nozzle in engagement with the aperture, for release of paste from the holder via the head to the cleaning body.

13 Claims, 6 Drawing Sheets

COMBINED PASTE-DISPENSING AND CLEANING UNIT

The present invention relates to a unit for cleaning, brushing, scouring, polishing and the like.

More particularly, the present invention relates to a unit having a handle terminating with a head, said head being provided with a cleaning body wherein said handle is interlockingly engageable with a paste-containing and dispensing container.

Units similar to those of the present invention are known in the art, especially with regard to combined toothbrush and toothpaste dispensers. Such units are described, e.g., in British Patent 2,067,396; U.S. Pat. No. 4,693,622 and German Specifications 2,416,001; 2,753,602 and 3,630,151.

All of said patents, with the exception of U.S. Pat. No. 4,693,622, describe and teach units with ducting means provided in the handle along the longitudinal axis thereof and leading to the brush portion of the toothbrush. As will be realized, said ducting means are prone to clogging and caking of paste within the narrow passages thereof and are extremely difficult to clean.

U.S. Pat. No. 4,693,622 teaches a slidably mounted toothbrush, which can be retracted to come in contact with a paste dispensing nozzle and then extended for use.

According to the present invention, there is now provided a unit for cleaning, brushing, scouring, polishing and the like, comprising a handle terminating with a head, said head having a cleaning body extending from a surface thereof and a throughgoing aperture, and said unit further comprising an external paste-containing holder having a paste-dispensing nozzle, said handle and said holder having means for interlocking engagement with said dispensing nozzle in engagement with said aperture, for release of paste from said holder via said head to said cleaning body.

In preferred embodiments of the present invention, said cleaning body is an array of bristles forming a brush; however, said cleaning body can also be formed from a sponge-like body, a fibrous mat, combinations thereof, or other materials used for cleaning, brushing, scouring, polishing and the like.

Thus the unit can be one for polishing shoes or polishing silver, for scouring pots or cleaning dishes; however, preferred are toothbrushing units wherein said head has an array of bristles extending therefrom and said paste-containing holder is provided with toothpaste therein.

In preferred embodiments of the present invention, said head is removably interlocked to said handle to facilitate the alternate engagement of different heads and cleaning bodies to said handle.

In equally preferred embodiments, said handle comprises a recess intermediate to its ends, sized to receive and retain at least a paste-containing section of said holder therein.

As will be realized, in contradistinction to the aforementioned prior art toothbrush units, the present invention provides a toothbrushing unit which contains the toothpaste of the user's choice in an attached holder, and which releases the required quantity of toothpaste directly onto the toothbrush's bristles through the exertion of light pressure by the user.

Practically, the holder may be changed with a new one when the toothpaste therewithin is finished, and the head of bristles may be exchanged to meet the user's changing needs and preferences.

Thus, in its most preferred embodiment, the present invention provides a toothbrushing unit comprising a toothbrush and a toothpaste holder containing toothpaste, the release of the toothpaste occurring directly from the toothpaste holder onto the bristles of the head, without need for a separate toothpaste tube.

After the assembly, the toothbrush and toothpaste holder comprise one unit, and from this moment until the toothpaste is finished, there is no need to separate the toothbrush from the toothpaste holder.

The toothbrushing unit provides optimum hygiene, since both toothbrush and toothpaste are personal. Gone are the days of the regular toothpaste tube used by the entire family as well as by guests, with contact between the toothpaste tube and the toothbrush. The toothbrushing unit carries the user's personal toothpaste, and there is no possibility of contact between the user's toothpaste and someone else's toothbrush.

The units of the present invention also preferably include a protective cover for said cleaning body when said unit is not in use, said cover being provided with a panel sized to project through a space provided in said cleaning body and to block said aperture in said head to prevent the drying of paste in said holder.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

IN THE DRAWINGS

Figure 1:
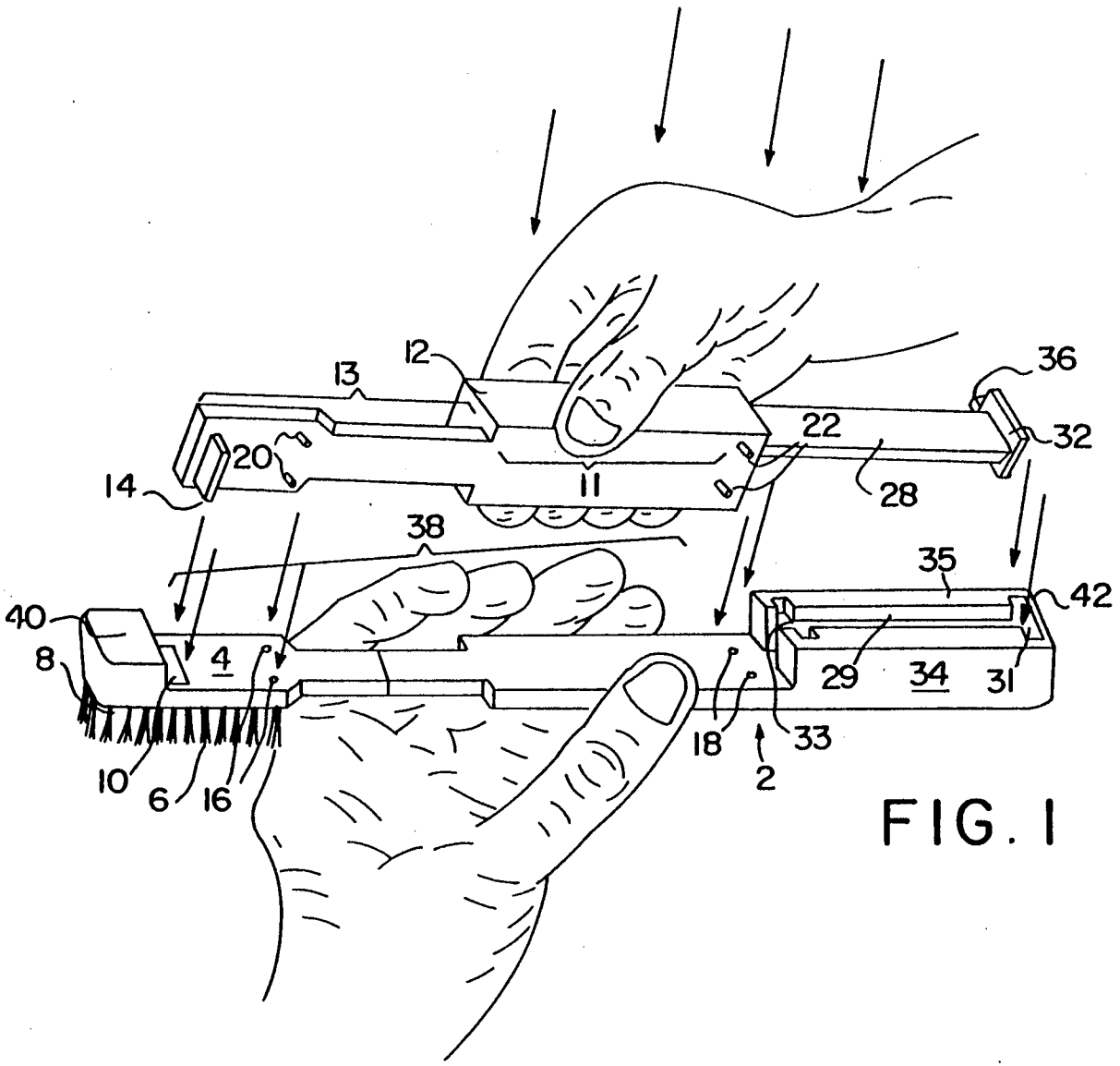
FIG. 1 is a perspective view of a preferred unit of the present invention in disassembled state.

Referring now to FIG. 1, there is seen a toothbrushing unit according to the present invention in disassembled or preassembled state.

Said unit comprises as a first sub-unit a handle 2 terminating with a head 4, said head 4 having a cleaning body formed from an array of bristles 6 extending from an interior surface 8 thereof and being provided with a throughgoing aperture 10.

Said unit further comprises as a second sub-unit an external paste-containing holder 12 having a paste-dispensing nozzle 14. Said handle 2 and said holder 12 are respectively provided with means, in the form of sockets 16, 18 and complementary pins 20, 22, for interlocking engagement to position said dispensing nozzle 14 in engagement with said aperture 10, as illustrated in FIG. 1, for release of paste from said holder via said head to said cleaning body 6. The nozzle projects from the holder a distance to pass through the aperture 10 and terminates adjacent the interior surface 8, so as to release the paste directly onto the cleaning body 6.

Figure 2:
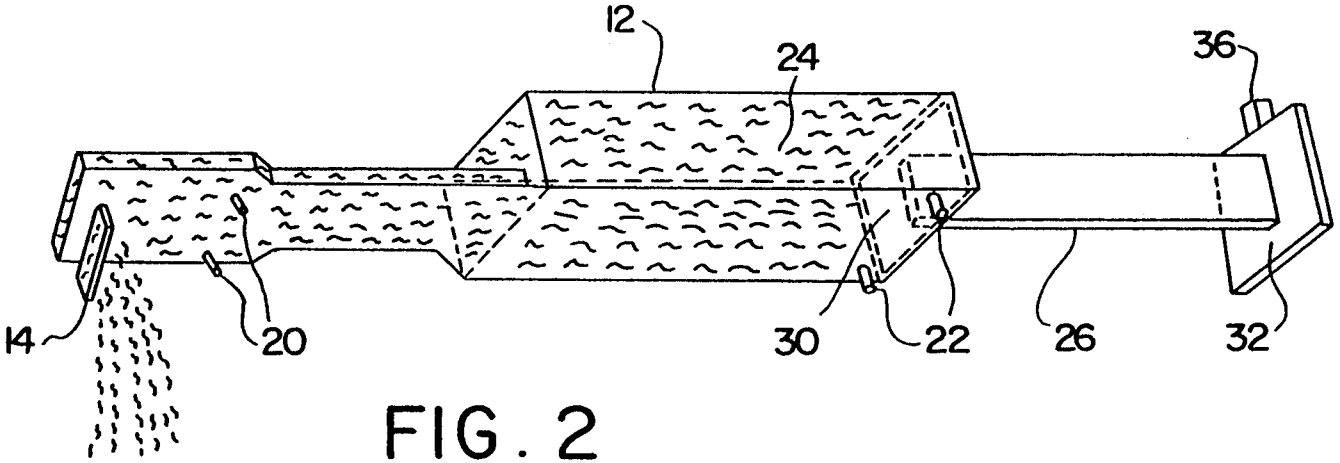
FIG. 2 is a perspective view of a preferred paste-containing holder for use in the present invention.

Referring to FIG. 2, in which a preferred transparent plastic paste-containing holder is illustrated in greater detail, it is seen that the holder 12 is of rectangular tubular cross-section filled with toothpaste 24. The holder is provided with an enlarged tubular rear paste-containing section 11 and a forward tubular paste-dispensing section 13 which connects said paste-containing section with the projecting nozzle 14. The paste-containing section has piston means 26 having a piston rod 28 terminating in a first surface 30 of outer dimensions complementary to the inner dimensions of the paste-containing tubular section and slidable therein to urge said paste 24 through said paste-dispensing section towards said paste-dispensing nozzle 14.

Said piston rod 28 extends rearwardly and terminates at its other end with a second surface 32 situated outside the holder 12 for manual actuation of said piston 26.

Referring briefly again to FIG. 1, it can be seen that the handle 2 of this preferred embodiment is provided at its rear end 42 with a hollow box-like structure 34 having a longitudinal slot 29 bracketed by a back lateral slot 31 and a front lateral slot 33 along the top surface 35 thereof. Said structure 34 forms an interior channel sized to receive said piston rod 28 and guide said second surface 32 of said piston 26 upon the interengagement of said handle 2 and said holder 12. Said second surface 32 is preferably also provided with an actuation flange 36 sized to project from said grooved channel through said slot 29.

Thus, as will be realized, the holder 12 contains the toothpaste 24 hermetically and at the appropriate pressure, so that when the actuation flange 36 presses the piston 26 into the holder, the toothpaste is squeezed out of the nozzle 14 which projects through aperture 10 in head 4 and terminates adjacent the surface 8 to feed the paste 24 directly to the bristles 6 of the cleaning brush.

Figure 3:
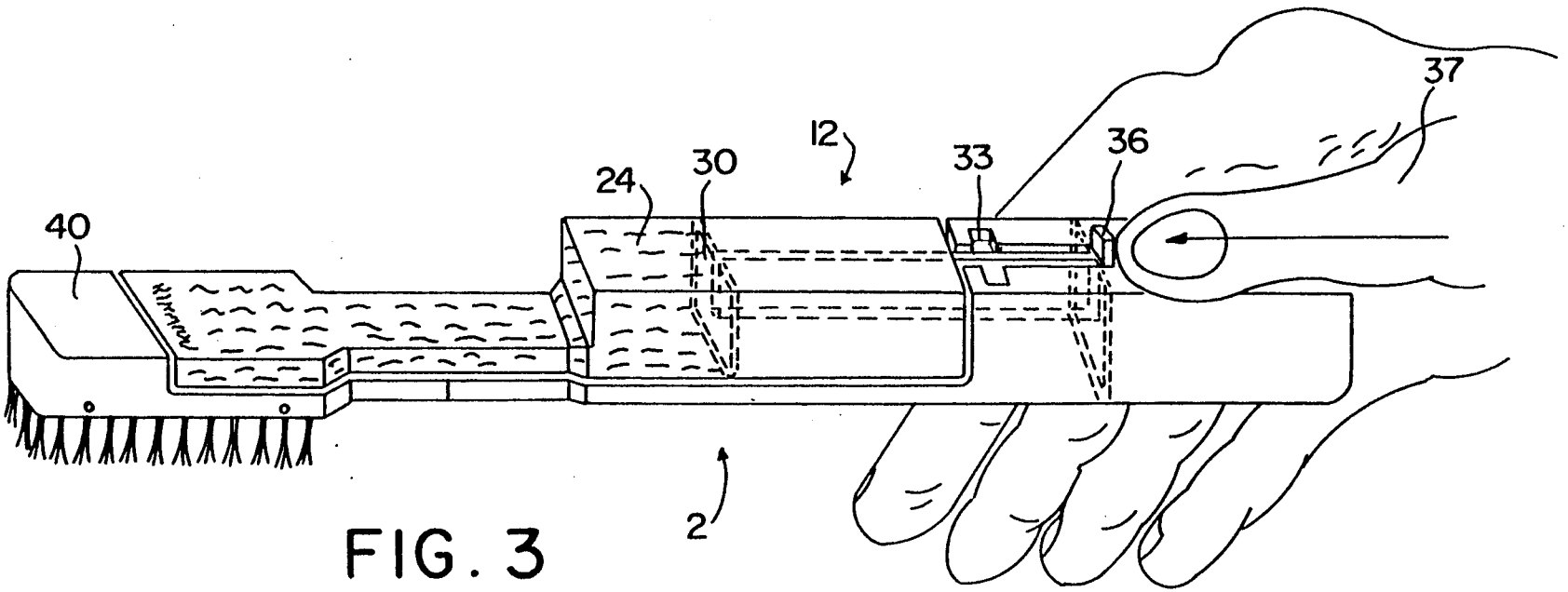
FIG. 3 is a perspective view illustrating the operation of the unit of the above figures.

Referring to FIG. 3, it can be seen that after interengagement of the handle 2 and the holder, the second surface 32 moves within the hollow handle end 34 as a result of pressure exerted on actuation flange 36. When the user exerts slight pressure upon actuation flange 36 with his thumb 37, the actuation flange presses the piston 26 into the toothpaste holder 12.

FIG. 3 shows first surface 30 midway along the toothpaste holder 12. Toothpaste 24 can be seen in the left side of the holder, while there is no toothpaste in the right side.

Referring again to FIG. 1, it is seen that the handle 2 of this preferred embodiment comprises a recess 38 intermediate between the end 40 of the head and the end 42 of the handle, sized to receive and retain at least a paste-containing section 11 and the paste-dispensing section 13 of said holder 12.

Referring again to FIG. 3, it can be seen that in this preferred embodiment, the height of the end 40 of the head of bristles is greater than that of any other part of the head. This is to ensure that the upper side of the toothbrush is uniform in height when the holder 12 is attached in recess 38. Thus, the part including the head 4 and the section 13 of the holder 12 which is inserted into the user's mouth is uniform in height, comfortable and not too tall, and in fact, this part resembles an ordinary toothbrush in its external appearance and height. The handle portion, with the paste-containing section 11 form an interlocked handle unit which is enlarged relative to the head which, when assembled to the paste-dispensing section, has a width smaller than the interlocked handle unit.

Figure 4:
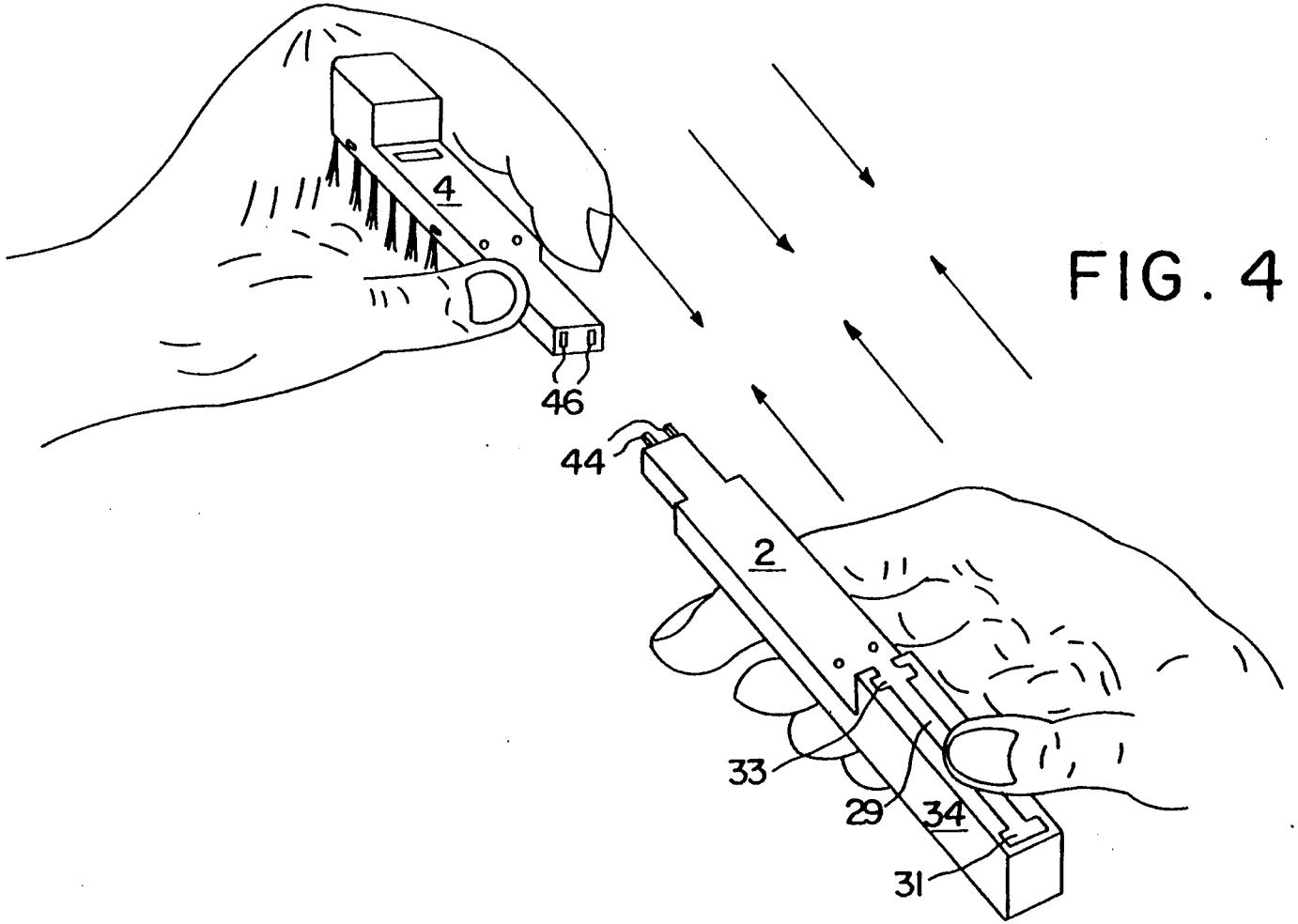
FIG. 4 is a perspective view of a preferred handle and head utilizable in the present invention.

As seen in FIG. 4, the handle 2 and head 4 can be provided with complementary interlocking means 44, 46 whereby said head is removably interlockable to said handle to facilitate the alternate engagement of different heads and cleaning bodies to said handle.

As will be realized, the ability to dismantle the head from the gripping handle provides the user with complete adaptability of the head to his personal requirements.

Figure 5:
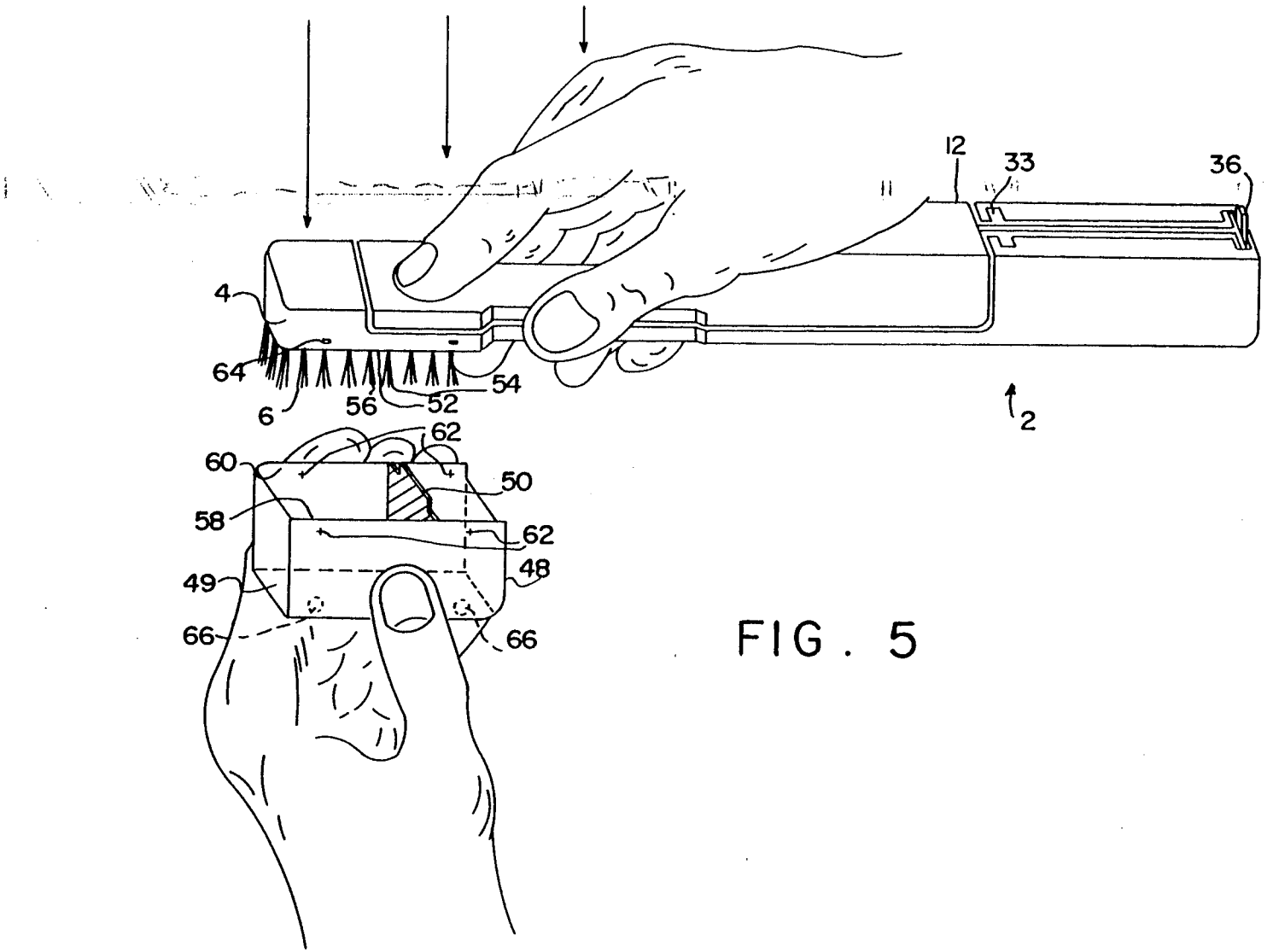
FIG. 5 is a perspective view of a preferred handle and head in assembled state and with a protective cover.

In FIG. 5 there is illustrated a toothbrush unit according to the present invention in assembled state wherein the array of bristles 6 extending from the head 4 is about to be covered by a protective cover 48. The cover 48 is preferably in the form of a container of rectangular cross-section and is open at its top. Said cover is provided with a panel 50 extending upwardly from the bottom 49 of said cover, sized to project through a space provided in the cleaning body of the unit, in this case in the space 52 between two rows of bristles 54, 56 which bracket the paste-dispensing aperture 10, in order to block said aperture 10 and prevent the drying of paste in said holder 12.

So that the protective cover 48 will readily be retained in place when the cleaning unit is not in use, there are provided on opposite inner side walls 58, 60 thereof inwardly facing pins 62 and said head is provided with complementary depressions 64 sized to receive and retain said pins 62.

Preferably, said cover is provided with ventilation holes 66 to allow for the proper aeration and drying of the bristles.

Figure 6:
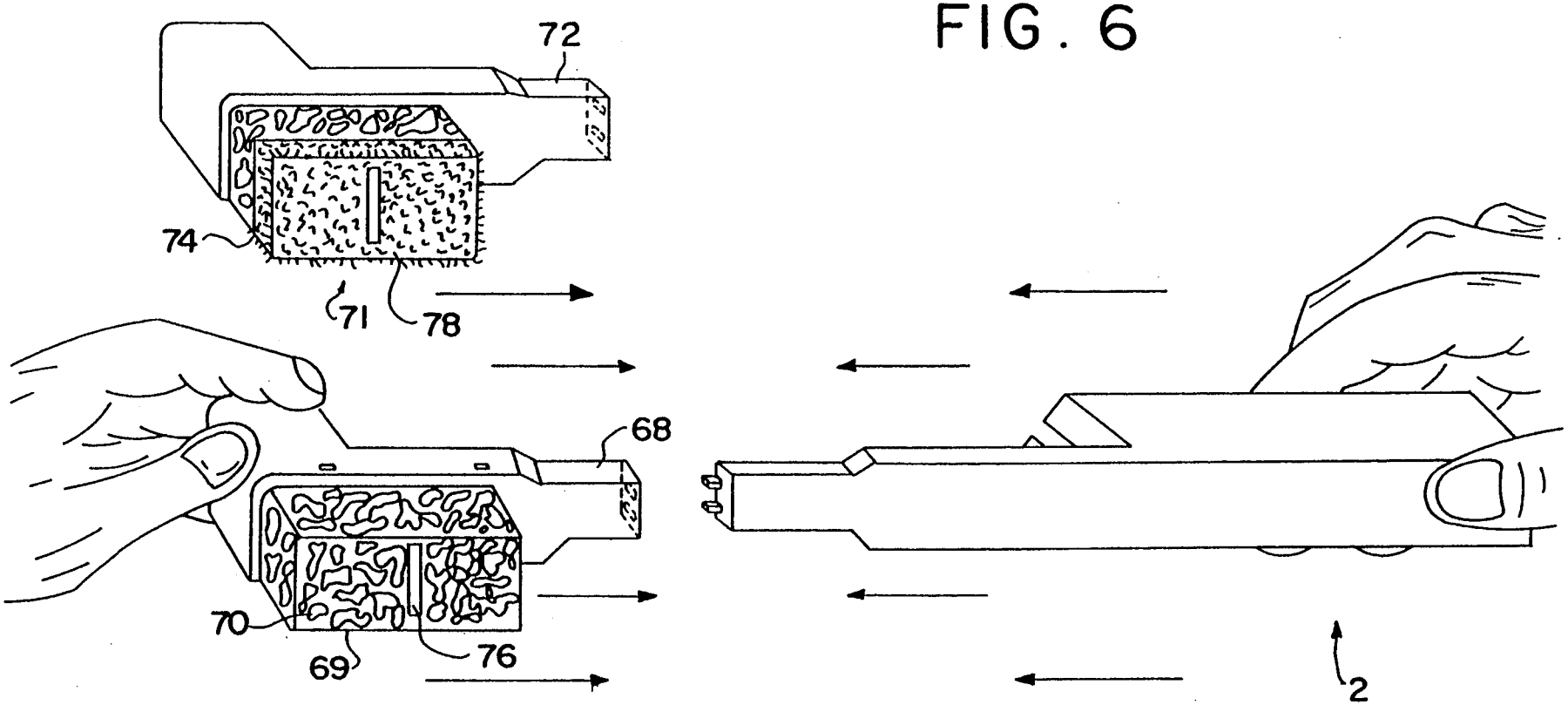
FIG. 6 is a perspective view of a unit for cleaning dishes and a replaceable head unit therefor.

In FIG. 6 there is seen a handle 2 adapted for alternative attachment to a head 68 having a cleaning body 69 made of sponge-like cellular material 70 or to a head 72 having a scouring cleaning body 71 made of cellular material covered by a mat of fibrous abrasive material 74. Both cleaning bodies 69, 71 are provided with openings 76, 78 so that panel 50 of a protective cover can pass therethrough to block the aperture 10 in said heads 68, 72.

Referring now to the figures in general, the method of using units according to the present invention is readily apparent and understood.

Thus, as a first step the gripping and carrying handle 2 is joined to the cleaning or brushing head 4 as shown in FIG. 4. The external paste-containing holder 12 is then joined to the handle 2 and head 4 unit.

Before the initial use, the piston 26 attached to the holder 12 is completely drawn out, as shown in FIG. 1. The paste-dispensing nozzle 14 fits exactly into the aperture 10 provided in head 2 and leading to the bristles. The pins 20, 22 on the undercarriage of the toothpaste holder 12 are inserted into the socket 18 upon the gripping and carrying part of the handle and the sockets 16 provided upon the head 4.

The piston rod enters channel in the structure 34 via longitudinal groove 29 with surface 32 and attached actuation flange 36 entering lateral groove 31.

After joining the toothpaste holder to the handle, the toothbrushing unit appears as is illustrated in FIG. 5. The user pushes the actuation flange 36 with his thumb along the longitudinal groove in the gripping and carrying handle as seen in FIG. 2. A light push is all that is necessary each use until the toothpaste holder is empty.

The toothpaste is pressed along the holder towards the sole outlet between the toothbrush's bristles. After each use, the toothbrush's head is rinsed like an ordinary brush, and the protective cover 48 is placed over the bristles and attached into position by means of the pins 62 on the internal side of the cover.

When no toothpaste is left inside the holder, the holder is easily dismantled from the handle. Piston surface 32 is aligned in the front lateral slot 33, the pins fastening the holder to the handle are disengaged and a light pull upward is all that is required to remove the holder from the handle.

A new holder can then be attached for further use. The head of bristles can be exchanged through the same procedure described above.

The preferred toothbrushing unit of the present invention circumvents the need for a separate toothpaste tube and toothbrush, raising the degree of dental hygiene by preventing contact between one toothpaste tube and different toothbrushes. It also facilitates dental hygiene away from home.

The toothbrushing unit enables the adaptation of toothpaste and head of bristles to the user's medical needs and personal preferences.

Convenience: no longer will there be any need to search for the toothbrush and the toothpaste tube separately, or to discover that the tube is empty (it will be possible to manufacture a transparent holder so the amount of toothpaste still available will be visible.) It may be possible to mark upon the holder the estimated time left until the toothpaste is finished.

After use the head of bristles is protected: if the brush falls on the floor, it will not get dirty.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A unit for cleaning, brushing, scouring, polishing and the like, comprising a handle terminating at its forward end with a head, said head having a cleaning body extending from an interior surface thereof and a throughgoing aperture, and said unit further comprising an external paste-containing holder having a paste-containing section and a paste-dispensing section having an outwardly-projecting paste-dispensing nozzle, said handle comprising a recessed section intermediate to its forward and rear ends sized to received and retain said holder with said paste-containing section adjacent the rear end thereof and said paste-dispensing section adjacent the front end thereof, said paste-containing section of said holder being of enlarged tubular cross-section relative to said paste-dispensing section and comprising piston means having a piston rod terminating in a first surface of outer dimensions complementary to the inner dimensions of said tubular section and slidable therein to urge said paste towards said paste-dispensing nozzle, said handle and said paste-containing holder having means for releasable interlocking engagement to position said dispensing nozzle in said throughgoing aperture provided in said head for release of paste from said paste-containing section through said paste-dispensing section to said nozzle, said nozzle dispensing the paste to said thoroughgoing aperture of said head and into said cleaning body.

2. A unit according to claim 1, wherein said head is removably interlocked to said handle to facilitate the alternate engagement of different heads and cleaning bodies to said handle.

3. A unit according to claim 1, wherein said piston rod terminates at the other end with a second surface situated outside the holder for manual actuation of said piston means.

4. A unit according to claim 3, wherein said handle is provided with a grooved channel sized to receive and guide said second surface of said piston means upon the interengagement of said handle and said holder.

5. A unit according to claim 4, wherein said second surface is provided with an actuation flange sized to project from said grooved channel.

6. A unit according to claim 1, wherein said holder is of substantially rectangular cross-section.

7. A unit according to claim 1, further comprising a protective cover for said cleaning body when said unit is not in use, said cover being provided with a panel sized to project through a space provided in said cleaning body and to block said aperture in said head to prevent the drying of paste in said holder.

8. A unit according to claim 1, wherein said cleaning body is an array of bristles.

9. A toothbrushing unit according to claim 1, said head having an array of bristles extending therefrom and said paste-containing holder having toothpaste therein.

10. A unit according to claim 1 wherein said handle is enlarged at its rear end and has a recessed portion to receive said enlarged paste-containing section of the holder, said interlocking means operable to interlock said paste-containing section in said recessed portion to form an interlocked handle unit.

11. A unit according to claim 10, for use as a toothbrush wherein said head and said paste-dispensing section form an interlocked head unit of uniform height and width smaller than said interlocked handle unit to assure comfortable use when inserted into the user's mouth.

12. A unit according to claim 1 wherein said releasable interlocking means comprise complementary pins and sockets in said handle and said holder.

13. A unit according to claim 1 wherein said nozzle projects from said paste-containing section a distance to pass through said aperture and terminate adjacent said interior surface, releasing the paste directly from said holder onto said cleaning body.

* * * * *